US005131096A

United States Patent [19]

Olson

[11] Patent Number: 5,131,096

[45] Date of Patent: Jul. 21, 1992

[54] VERSATILE CHILD'S GARMENT

[76] Inventor: Debra K. Olson, 335 David Ct., D., Bartlett, Ill. 60103

[21] Appl. No.: 807,496

[22] Filed: Dec. 16, 1991

[51] Int. Cl.[5] ..... A41D 11/00

[52] U.S. Cl. ..... 2/75; 2/69; 2/69.5; 2/83; 2/89

[58] Field of Search ..... 2/75, 69, 69.5, 83, 2/89

[56] References Cited

U.S. PATENT DOCUMENTS 1,661,768 3/1928 Marshall ..... 2/75
2,546,057 3/1951 Bodin et al. ..... 2/75
3,034,132 5/1962 Landsberger et al. ..... 2/69.5
3,477,065 11/1969 Hoover ..... 2/69.5

*Primary Examiner*—Werner H. Schroeder
*Assistant Examiner*—Gloria Hale
*Attorney, Agent, or Firm*—Charles F. Meroni, Jr.

[57] ABSTRACT

The versatile child's garment may be used for an infant as a changing blanket and bunting, the garment including a self-storing pacifier and a plurality of outer pockets which can accommodate items necessary to an infant when travelling. As the infant grows into a toddler, the garment becomes a sleeveless beach robe or sleeved bath robe, providing an increased useful life for the garment.

20 Claims, 3 Drawing Sheets

VERSATILE CHILD'S GARMENT

BACKGROUND OF THE INVENTION

The present invention relates to a garment for a child which can serve in a plurality of capacities, as well as serving to accommodate the carrying of various articles therein.

PRIOR ART

Heretofore numerous versatile garments for children have been proposed.

For example, the Mazur, U.S. Pat. No. 3,965,487 discloses a multi-use infant garment comprising an upper garment having at least a chest section and a back section, both of which define a lower edge. A lower garment which may consist of a bag-like, pant or legging-type garment is also provided and is detachably secured to the upper garment by fastening means.

Further, the Mulligan U.S. Pat. No. 4,759,082 discloses a garment for small children, useable as both day wear and sleepwear. The garment includes a body portion having a plurality of openings therein for accommodating the extremities and head of the child. The body portion is dimensioned such that the extremities may be selectively drawn into the garment. The opening for the feet may include a drawstring, creating a bunting for an infant, and a pillow for the child's head is provided as well.

Also, the Perez U.S. Pat. No. 4,811,429 discloses unitary sleepwear which comprises a two piece night garment including a torso embracing portion and a lower blanket portion which wraps around the lower torso and snaps onto the torso embracing portion, to keep a child covered during the night without restricting mobility.

As will be described in greater detail hereinafter, the versatile child's garment of the present invention comprises an armless torso portion having a hood and a bottom margin which can be left open or closed, as desired, and sleeve elements which can be engaged to the torso portion as desired. Further, a plurality of pockets are provided along a front portion of the bottom margin, openings into the pockets being elasticized. Depending on the chosen pattern of engagement of the elements of the garment, it can serve as a bunting, as a sleeping bag, as a diaper bag or as a changing blanket for an infant and can later serve as a sleeved or sleeveless bath or beach robe for a toddler.

SUMMARY OF THE INVENTION

According to the invention there is provided a versatile child's garment comprising multiple members and including two sleeve members and a torso portion, the torso portion comprising a rectangular blanket-like structure having long top and bottom edges and two short side edges, with a hood being centrally attached along the top edge, the rectangular blanket-like structure further having two converging edge cutouts extending to a predetermined distance, one to either side of the hood, the sleeve members being releasably engageable about the cutouts to form a sleeved garment, if desired.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
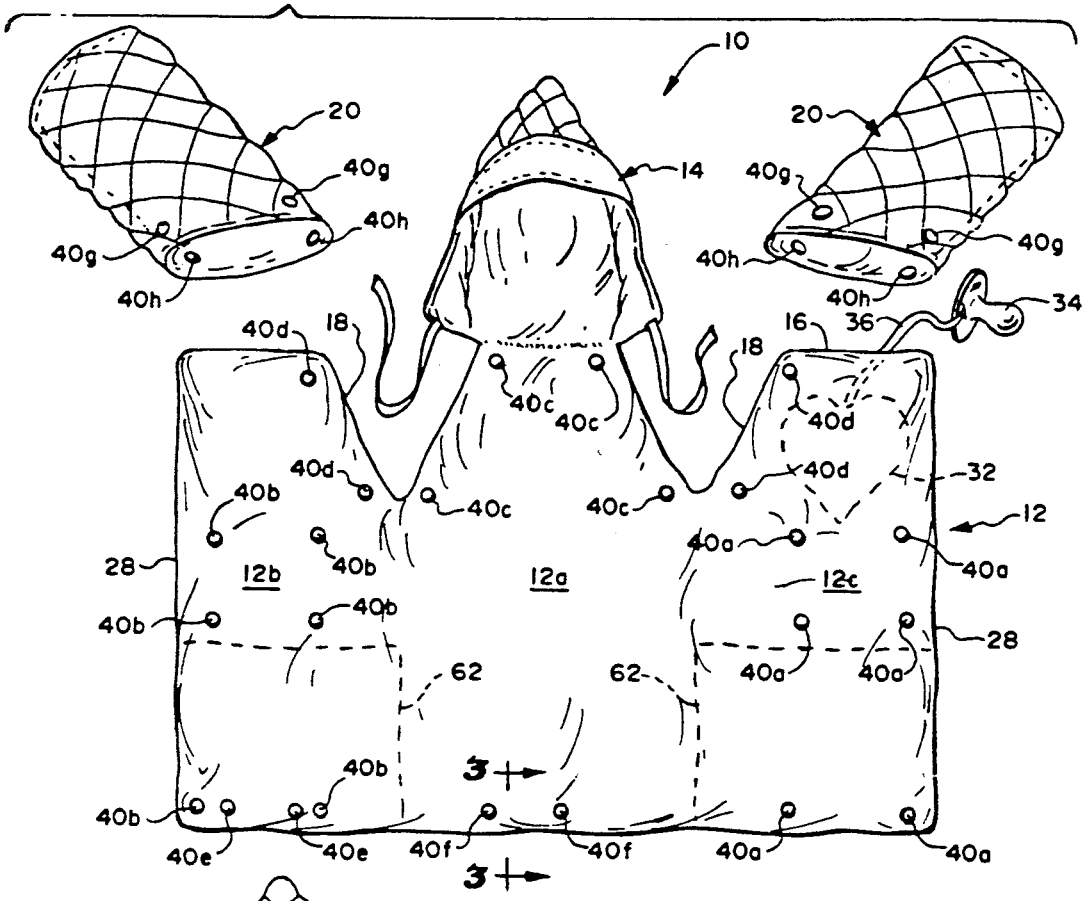
FIG. 1 is an exploded perspective view of the garment of the present invention.

Referring now to the drawings in greater detail there is illustrated in the drawings the versatile child's garment of the present invention generally identified by reference numeral 10.

As shown, the garment 10 basically comprises a torso portion 12, having the general shape of a rectangular blanket, the torso portion 12 having a hood 14 attached along a long top edge 16 thereof, and including a converging edge cutout 18 to either side of the hood 14 extending inwardly into the torso portion 12 from the edge 16.

Two sleeve members 20 are also provided, each of which can be engaged within one of the converging edge cutouts 18 to form a sleeved garment 10.

All engagements between various elements of the garment 10 are created by means of cooperating snap sections as will be defined hereinafter.

The torso portion 12, laid out as shown in FIG. 1, acts as a blanket, on which an infant can be placed for a diaper change, or upon which a toddler can sit.

Between short side edges 28 of the torso portion 12, there are defined three panels. Between the converging edge cutouts 18 is defined a back forming panel **12*a***.

To the left of back forming panel **12*a* in FIG. 1 is defined first or inner front panel 12*b* and to the right of panel 12*a* is defined second or outer front panel 12*c***.

Figure 2:
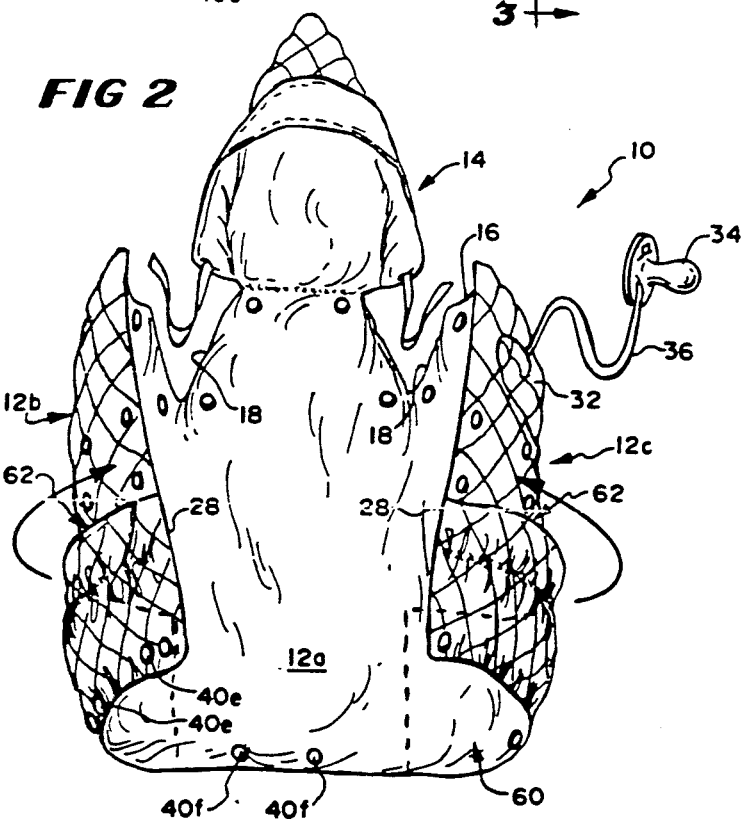
FIG. 2 is a perspective view of the torso portion of the garment being folded into a bunting.
Figure 3:
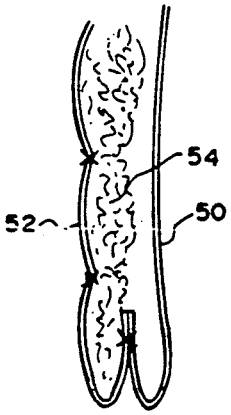
FIG. 3 is a cross section through the torso portion taken along line 3—3 of FIG. 1.

In FIG. 2, side edges 28 of the torso portion 12 are shown being brought together, with panel **12*b* to underlie panel 12*c*, forming a front surface 30 (FIGS. 7 and 8) for a bunting-type garment 10 produced upon forming an engagement between the panels 12*a*, 12*b* and 12*c***.

Now, a heart shaped pocket 32 provided on outer front panel **12*c* becomes evident, the pocket 32 storing a pacifier 34 therein, the pacifier 34 being engaged to the garment 10 to prevent its loss by a ribbon 36 or the like extending into the pocket 32**.

To engage inner and outer front panels **12*b* and 12*c* together a plurality of pairs of snap elements 40*a* are provided on panel 12c and cooperating snap members 40b are provided on panel 12b**.

Figure 4:
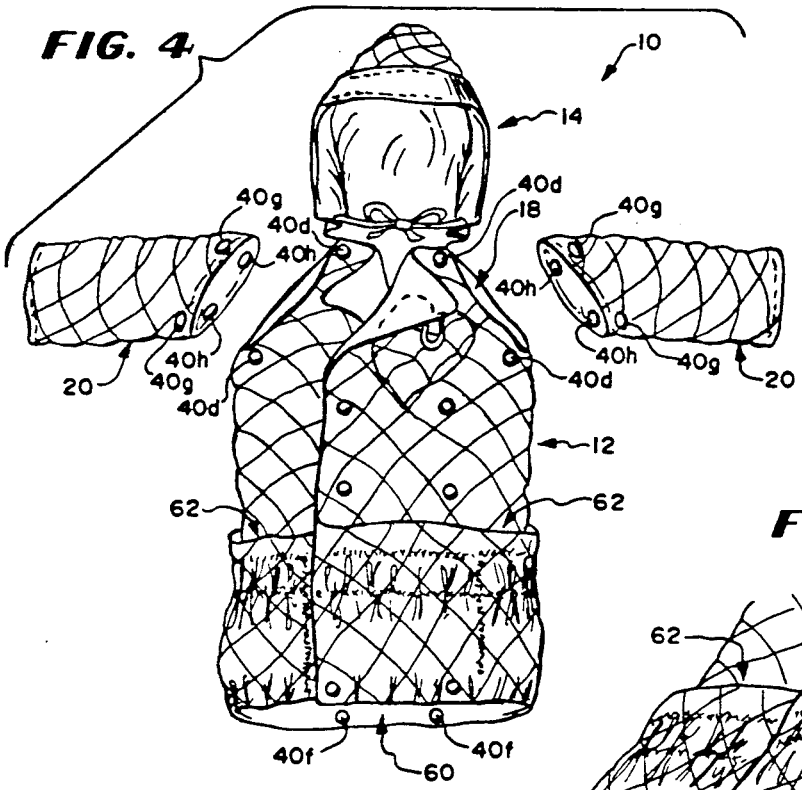
FIG. 4 is a perspective view of the garment of FIG. 2 showing alignment of sleeve members to be engaged to the torso portion.
Figure 7:
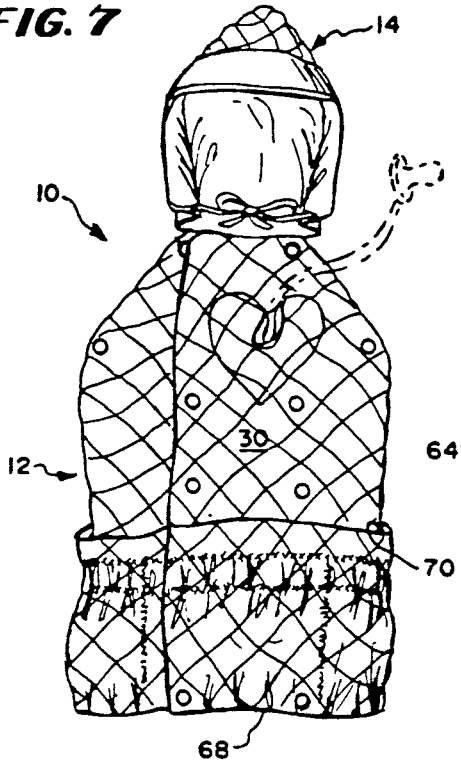
FIG. 7 is a front view of the garment and shows the garment formed into a bunting and including a self-storing pacifier thereof.

When cooperating snap members 40a and 40b are engaged to one another, a bunting garment 10 as shown in FIGS. 4 and 7 begins to take shape.

To provide a cushioning for an infant or child wearing the garment 10, the garment 10 is formed of an inner lining layer of material 50, an outer layer of material 52, and an intermediate layer of batting 54 which is secured to outer layer 52 by known methods, such as quilting.

Obviously, quilted material may be used and lined, with the inner lining layer of material 50 preferably being made of cotton for comfort, and with the outer or quilted layer of material 52 preferably being made of a flame retardant material.

Figure 8:
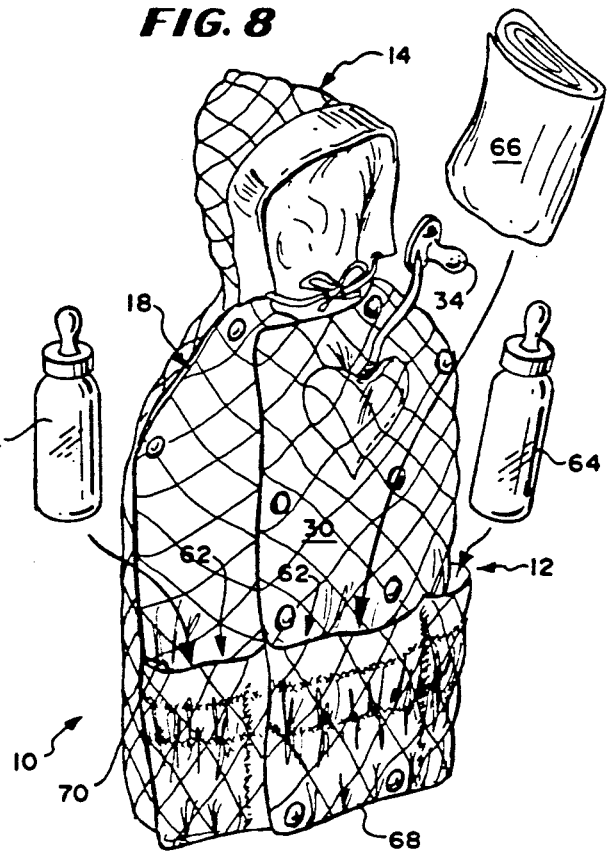
FIG. 8 is a perspective view of the garment of FIG. 7 and shows the front pockets of the bunting being filled with baby items.

To complete creation of the bunting garment 10, illustrated in FIGS. 7 and 8, further pairs of cooperating snap members 40c and 40d are provided about the converging edge cutouts 18 to create engagement between the back panel section 12a and front panel sections 12b and 12c across the cutouts 18.

When these snap members 40c and 40d are engaged, the only opening remaining in the bunting garment 10 is a bottom opening 60.

Figure 9:
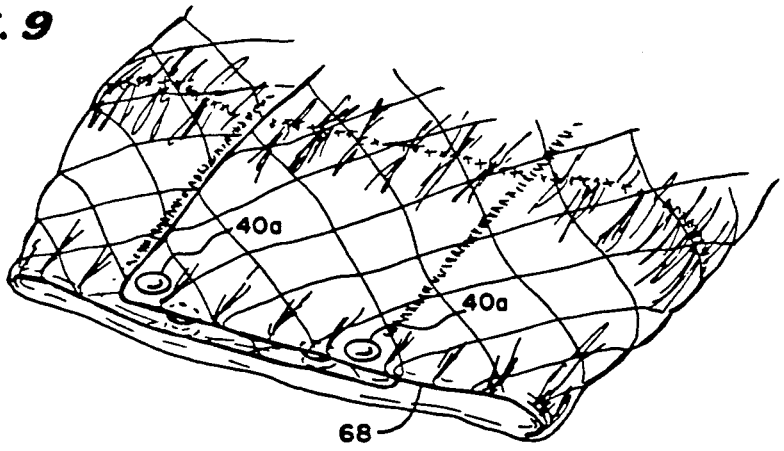
FIG. 9 is a view similar to that of FIG. 6 and shows the front forming panels being engaged to a back forming panel to close the bottom margin of the torso portion.

To close off the bottom opening 60, snap members 40e are provided on front panel 12b and cooperating snap members 40f are provided on back panel 12a. When engaged as shown in FIG. 9, a closed bottom bunting garment 10 is created.

Because an infant requires certain items while away from home, a plurality of outside pockets 62 are provided on front panels 12b and 12c which can accommodate articles such as formula bottles 64, diapers 66, etc. These pockets 62 extending upwardly from a bottom margin 68 of the garment 10 and may have openings 70 thereof elasticized, to keep the items from falling out.

Figure 5:
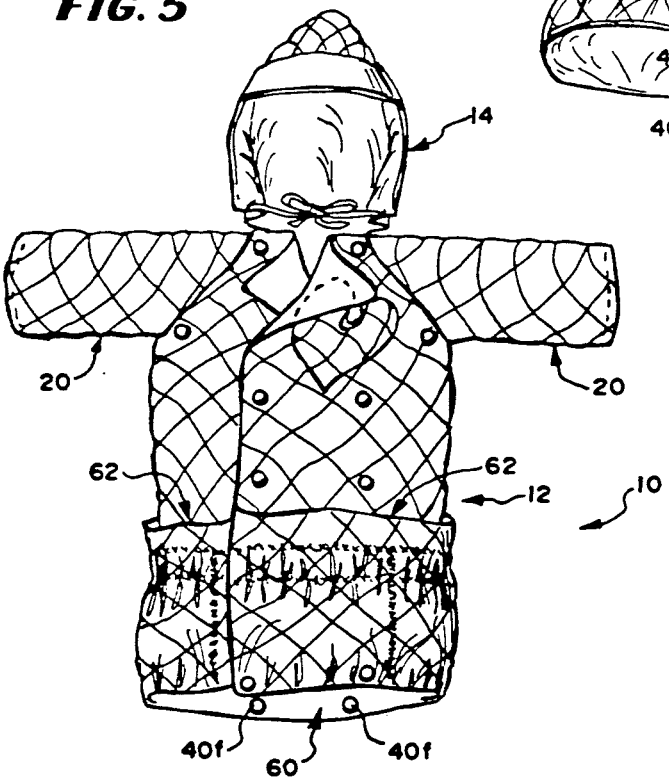
FIG. 5 is a perspective view showing the torso portion with the sleeve members engaged thereto.

Turning back to FIGS. 4, 5 and 6, it will be understood that, as the infant grows into a toddler, the child's arms could be freed from being within the garment 10. Also, as the child's height increases, the legs should be capable of extending out of the bottom opening 60.

Figure 6:
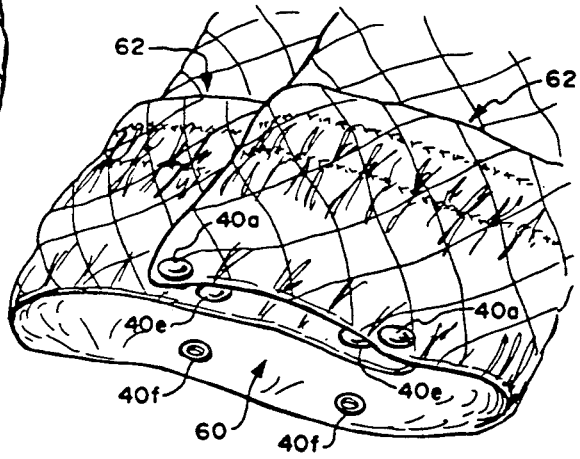
FIG. 6 is a perspective view of a bottom margin of the torso portion showing front forming panels thereof engaged to one another.

To accommodate this growth, it will first of all be understood that the bottom margin 68 of the garment could remain open, as shown in FIG. 6, creating a robe like garment 10 which is sleeveless, such as a beach robe.

If a sleeve garment 10 is desired, such as for use as a bath robe, snap members 40c and 40d are disengaged from one another and are instead each engaged to coacting snap members 40g or 40h, respectively, provided on each sleeve member 20.

Thus, the useful life of the garment 10 extends well into the toddler years, the pockets 62 now accommodating toys and the like.

As described above, the garment 10 of the present invention provides significant advantages, some of which have been described above and others of which are inherent in the invention. Also, modifications may be proposed to the garment 10 without departing from the teachings herein.

Accordingly, the scope of the invention is only to be limited as necessitated by the accompanying claims.

I claim:

1. A versatile child's garment comprising two sleeve members and a torso portion, the torso portion comprising a rectangular blanket-like structure having long top and bottom edges and two short side edges, with a hood being centrally attached along said top edge, the rectangular blanket-like structure further having two converging edge cutouts therein extending from said top edge a predetermined distance, one adjacent to either side of the hood.

2. The garment of claim 1 wherein said blanket-like structure comprises three parallel panels defined between said side edges, and merging into one another in the areas below the converging edge cutouts.

3. The garment of claim 2 wherein a back panel is defined in the area between the cutouts.

4. The garment of claim 3 wherein first and second lateral front panels are defined to either side of the back panel and extend to the side edges of the blanket-like structure.

5. The garment of claim 4 wherein said first front panel folds over said back panel and said second front panel folds over said first panel.

6. The garment of claim 5 wherein each converging edge cutout is defined by converging edges which overlie one another when the front panels are folded over said back panel.

7. The garment of claim 6 wherein the front panels include releasable cooperating engagement means thereon for engaging them together.

8. The garment of claim 7 wherein cooperating releasable engagement means are provided on the edges of each cutout for engaging the edges together.

9. The garment of claim 8 wherein said back panel and said first front panel include releasable cooperating engagement means thereon along said bottom edge thereof.

10. The garment of claim 9 wherein said front panels each have an outer surface and have pockets provided thereon.

11. The garment of claim 10 wherein said pockets extend upwardly from said bottom edge a predetermined distance.

12. The garment of claim 11 wherein said second front panel includes a further pocket therein, located in an area near a corresponding converging edge cutout, said pocket having a pacifier therein, the pacifier being engaged to the garment by a ribbon extending into said pocket.

13. The garment of claim 12 wherein said sleeve members each include engagement means thereon which are releasably engageable to said engagement means provided along the edges of each cutout for engagement of the sleeve members to the torso portion.

14. The garment of claim 13 including an outer layer of quilted material and an inner layer of lining material.

15. The garment of claim 14 wherein said inner layer of lining material is cotton.

16. The garment of claim 15 wherein said layer of quilted material is flame retardant.

17. The garment of claim 16 wherein said engagement means comprise snaps.

18. A versatile child's garment having an extended useful life from infancy through the toddler stage of the child, the garment comprising a torso engaging portion and sleeve members releasably secured within cooperating openings provided therefor in said torso engaging portion, said torso engaging portion having a bottom edge from which a back panel and first and second lateral front panels upwardly extend to a top edge of said torso engaging portion, said front panels being releasably secured to one another and said first front panel and said back panel being releasably secured to one another along said bottom edge.

19. The garment of claim 18 wherein said front panels include pockets thereon which extend upwardly from said bottom edge a predetermined distance.

20. The garment of claim 19 including releasable sleeve engaging means on said torso engaging portion which comprise cooperating engagement elements which are engage each other in a manner to close said openings in said torso engaging portion within which said sleeve members engage when said sleeve members are disengaged therefrom.

* * * * *